United States Patent [19]

Moeser

[11] 4,281,426

[45] Aug. 4, 1981

[54] BOAT SEAT MOUNTING UNIT

[75] Inventor: Denis S. Moeser, Clayton, Mo.

[73] Assignee: Leisure Products, Inc., St. Louis, Mo.

[21] Appl. No.: 909,378

[22] Filed: May 26, 1978

Related U.S. Application Data

[63] Continuation-in-part of Ser. No. 804,995, Jun. 9, 1977, Pat. No. 4,122,571.

[51] Int. Cl.[3] ..... B63B 29/00

[52] U.S. Cl. ..... 9/7

[58] Field of Search ..... 9/7; 114/194; 269/97; 248/226.4; 297/252

[56] References Cited

U.S. PATENT DOCUMENTS

| | | | |
|---|---|---|---|
| 1,136,701 | 4/1915 | Morse | 269/97 |
| 1,651,712 | 12/1927 | Karelius | 269/97 |
| 2,843,348 | 7/1958 | Samuels | 9/7 |
| 3,113,804 | 12/1963 | Ritter | 297/252 |
| 3,677,216 | 7/1972 | Gentemann | 115/24.1 |
| 3,789,444 | 2/1974 | McCord | 9/7 |
| 3,795,927 | 3/1974 | Darwin et al. | 9/7 |
| 3,821,825 | 7/1974 | Bailey | 9/7 |

FOREIGN PATENT DOCUMENTS

| | | | |
|---|---|---|---|
| 609392 | 9/1948 | United Kingdom | 269/258 |

OTHER PUBLICATIONS

1976, Wholesale Distributors Catalogue, Covert Marine.

*Primary Examiner*—Trygve M. Blix
*Assistant Examiner*—Jesús D. Sotelo
*Attorney, Agent, or Firm*—Senniger, Powers, Leavitt and Roedel

[57] ABSTRACT

A unit for mounting a seat on a boat thwart or the like. The unit includes a base to rest on the thwart for securement thereto of the seat and a clamping assembly carried by the base for clamping the base on the thwart. This clamping assembly comprises a pair of arms extending outwardly from opposite sides of the base with each arm having a clamping shoe at its outer end. The shoes are engageable with opposite sides of the thwart for clamping the base to the thwart. The shoes are roughly adjusted quickly to space the shoes apart a distance somewhat greater than the width of the thwart for application of the unit to the thwart and then finely adjusted to draw them into clamping engagement with opposite sides of the thwart.

21 Claims, 16 Drawing Figures

BOAT SEAT MOUNTING UNIT

CROSS-REFERENCE TO RELATED APPLICATION

This is a continuation-in-part of application Ser. No. 804,995, filed June 9, 1977, now U.S. Pat. No. 4,122,571.

BACKGROUND OF THE INVENTION

This invention relates generally to means for mounting a seat and in particular to a boat seat mounting unit adapted to be clamped onto a boat thwart.

On smaller boats, such as for instance a johnboat or other fishing or game-type boat, thwarts serve not only for structural support between the gunwales but also as seats for the boatman and passengers. Inasmuch as a thwart seat does not provide any back support, however, it is oftentimes desirable to mount a seat such as a plastic or fiber glass molded contour seat (often referred to as a "legless chair") on the thwart. It is also advantageous to be able to quickly and easily mount the seat and to demount it from a thwart seat rather than having it permanently attached thereto so that the seat may be readily be transferred from one boat to another and stored during nonuse. With the seat removed, the boat may more readily be transported in inverted position on top of a car or stacked with other boats in nested fashion. Moreover, it is often convenient to be able to quickly and easily reposition the seat on the thwart in order to fish from a different location in the boat and also to keep the boat in trim and on an even keel under various load conditions.

Boat seat mounting units of the clamp-on type have been known in the past and are shown on page 271 of the 1976 Wholesale Distributors Catalogue published by Covert Marine, and in U.S. Pat. Nos. 3,789,444, issued Feb. 5, 1974, and 3,113,804, issued Dec. 10, 1963. Heretofore, however, mounting units of this type have presented certain problems, one being that they did not grip the thwart with sufficient force to rigidly mount the boat seat on the thwart, thus resulting in the tendency of the boat seat to slide on the thwart upon any sudden movement of the person in the seat. The seat would sometimes even pop off the thwart entirely. In addition, many units were adjustable to fit only thwarts having widths falling within a very narrow range, and adjustments were time-consuming and tedious to make. These prior art units were also limited as to the types of thwarts on which they could be mounted. Many units, for example, could be properly mounted only on a thwart having a top surface overhanging the thwart sides.

SUMMARY OF THE INVENTION

Among the several objects of this invention may be noted the provision of an improved detachable boat seat mounting unit which firmly mounts the boat seat on a thwart; the provision of such a unit which is quickly and easily adjustable over a wide range for fitting a boat thwart of any width within that range; the provision of such a unit which may quickly and easily be mounted on and demounted from the thwart of a boat without damaging the thwart or requiring modifications thereto; the provision of such a unit which is suited to fit all types of thwarts; the provision of a boat seat mounting unit which is foldable to a collapsed portable position for easy transportation and storage; and the provision of an improved mounting unit which is simple and economical in construction for lower cost yet durable.

Briefly, the improved boat seat mounting unit of this invention comprises a base adapted to rest on a boat thwart and to have the seat secured thereto, and means carried by the base for clamping it on the thwart. This clamping means includes a pair of arms extending outwardly from opposite sides of the base with each arm having a clamping shoe at its outer end. The shoes are engageable with opposite sides of the thwart for clamping the base thereto. Rough adjustment means are provided for quickly adjusting the shoes to space them apart a distance somewhat greater than the width of the thwart for application of the unit to the thwart, and fine adjustment means draw the shoes into clamping engagement with opposite sides of the thwart. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
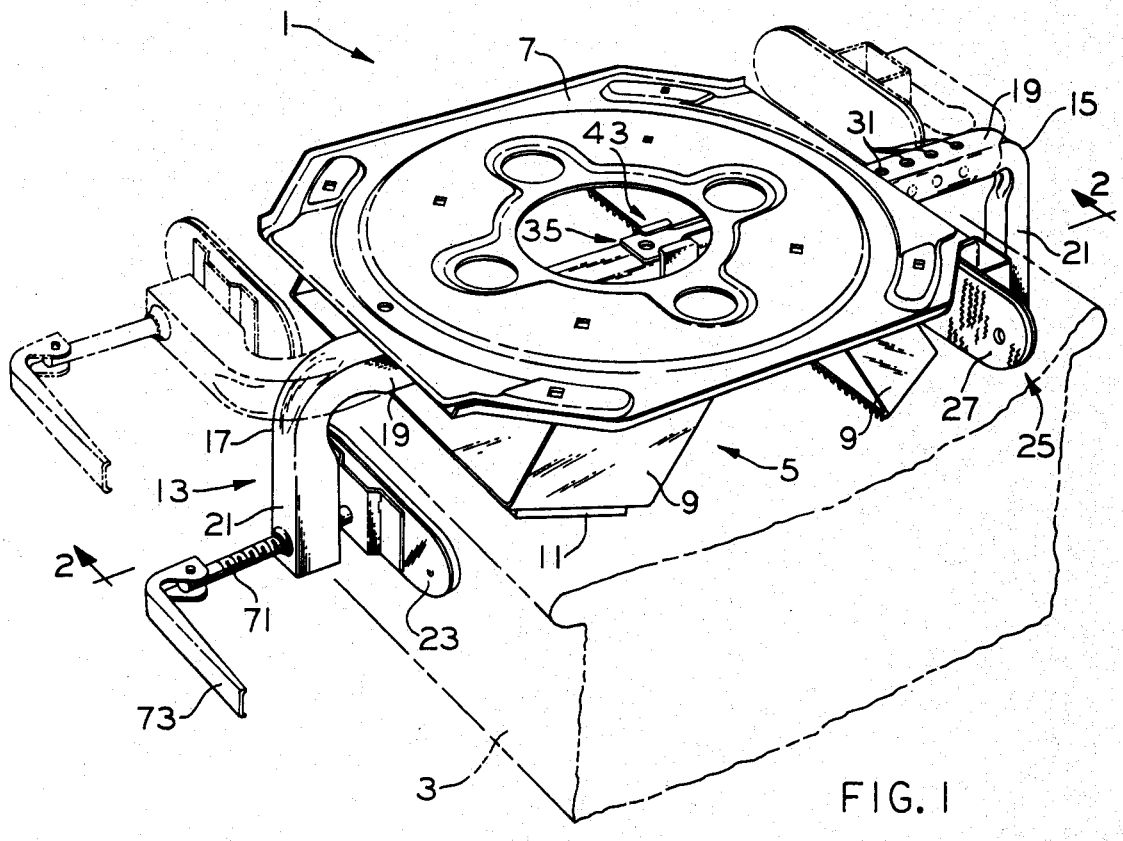
FIG. 1 is a perspective showing a boat seat mounting unit of this invention mounted on a boat thwart, the latter being shown in phantom.

Referring to the drawings, particularly to FIG. 1, a boat seat mounting unit of this invention is indicated generally at 1 and is shown mounted on a bench-type structure, such as a thwart 3 of a boat. The unit generally comprises a base 5 which, in turn, includes a mounting plate 7 on which a contoured swivel seat 8 may be secured and a pair of U-shaped members (as viewed from the sides of thwart 3), each designated 9, on the bottom of the plate 7 for supporting the plate and the seat thereon atop the thwart. Each of the members 9 has a pad 11 of rubber or other suitable material on its bottom for preventing the base from sliding on the thwart.

Figure 2:
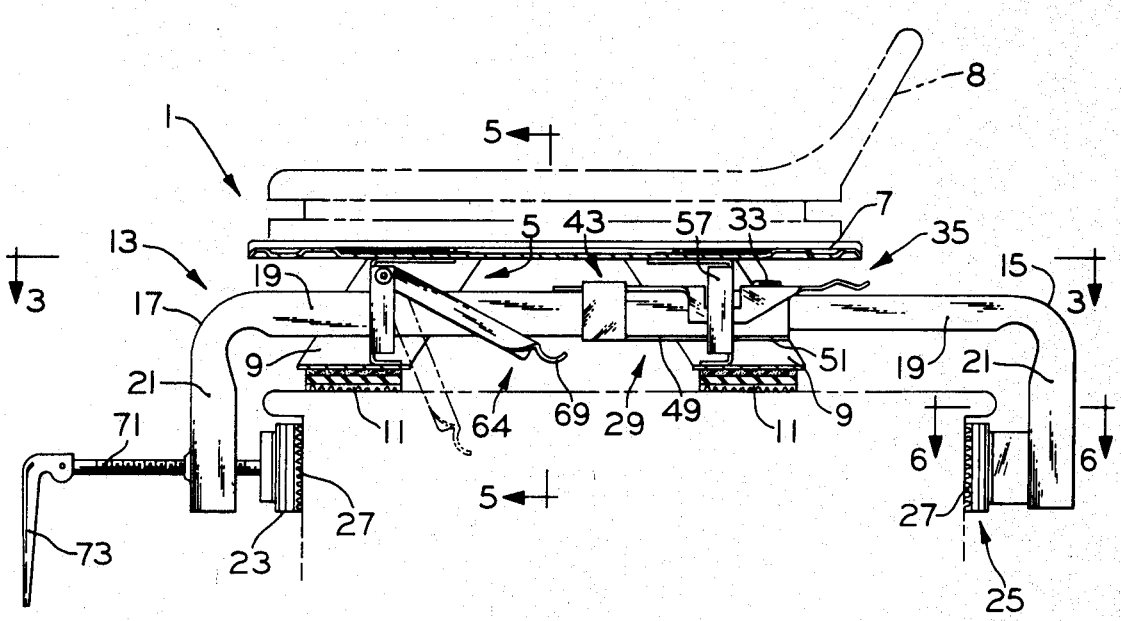
FIG. 2 is a section on line 2—2 of FIG. 1.

In accordance with this invention, means generally indicated at 13 is carried by the base 5 for clamping it on the thwart. This means 13 comprises a pair of arms 15, 17 projecting outwardly from opposite sides of the base 5 below mounting plate 7 and extending through members 9. These arms are constructed of tubes of generally square cross section (albeit other configurations may also be suitable), and arm 15, the right arm as viewed in FIG. 2, is telescopically fitted inside arm 17, the latter being mounted on base 5 in a manner to be described hereinafter. Each arm is generally L-shaped, having an inner portion 19 and an outer end portion 21 extending generally perpendicularly therefrom, and has a clamping shoe mounted on its outer end portion 21, the shoe on the fixed arm 17 being indicated at 23 and the shoe on the telescoping arm 15 generally at 25. Shoes 23, 25, which are generally elongate in shape, are engageable with opposite sides of the thwart for clamping the base to the thwart, and, as with the members 9, they have padding 27 on their inside faces for a firm frictional grip on the sides of the thwart without damaging the thwart. Although unit 1 is shown to have only two arms, it will of course be understood that any number of arms could be used.

Figure 3:
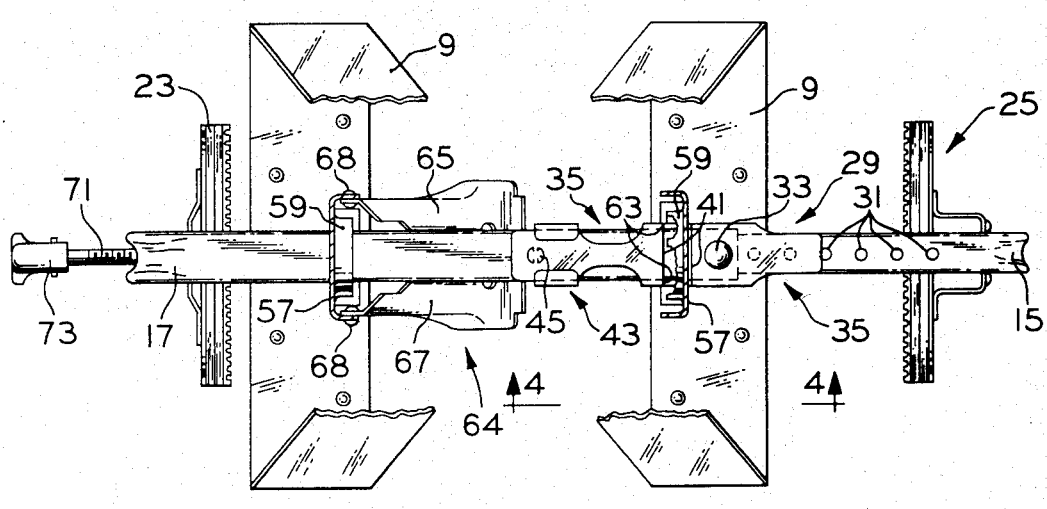
FIG. 3 is a plan of FIG. 1 with portions broken away to illustrate details, including details of a snapfastener assembly for locking certain arms of the unit in any one of a plurality of predetermined positions.
Figure 4:
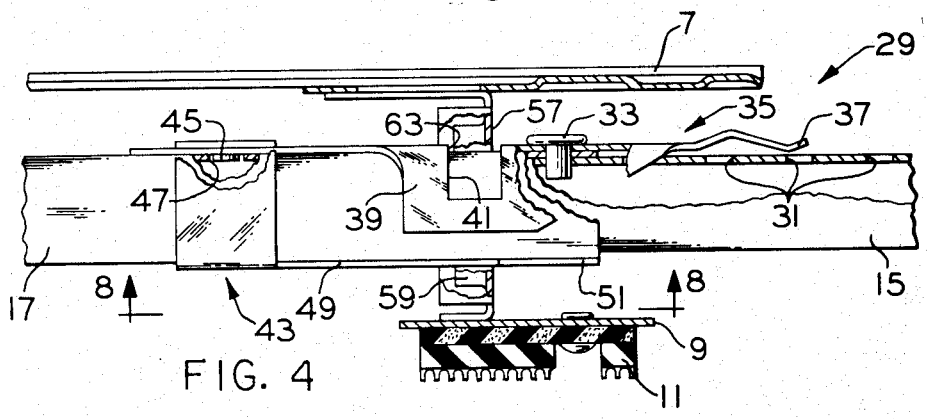
FIG. 4 is an enlarged section on line 4—4 of FIG. 3 with portions broken away illustrating further details of the snap-fastener assembly.
Figure 5:
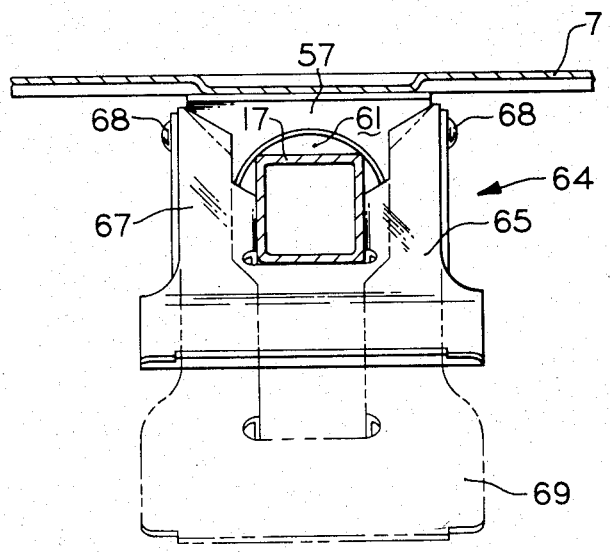
FIG. 5 is an enlarged section on line 5—5 of FIG. 2 illustrating means for locking the arms in their unfolded and folded positions.

Means for roughly adjusting the shoes 23, 25 to quickly space them apart a distance somewhat greater than the width of the thwart for application of the unit 1 to the thwart is shown in FIGS. 3 and 4 to comprise fastener means, and more particularly a snap-fastener assembly, generally designated 29, for securing arms 15, 17 in any one of a plurality of adjusted positions depending on the width of the thwart. This snap-fastener assembly 29 includes a series of openings, each designated 31, spaced along the length of the telescoping arm 15, and a detent 33 on the other arm 17 carried at the right (as viewed in the drawings) end of an elongate leaf spring generally indicated at 35 which biases detent 33 downwardly into any selected opening 31. Spring 35, secured at its left end to arm 17, extends along the top of arm 17 and is bent upwardly at its right end as shown at 37 for providing a finger grip to lift the detent 33 out of the opening 31, thus allowing arm 15 to be quickly telescoped in or out of arm 17 to the appropriate adjusted position (in which the shoes 23, 25 are spaced apart a distance somewhat greater than the width of the thwart) and then resecured in that adjusted position. This arrangement is advantageous in that it allows the arms to be readily adjusted over a wide range to space the shoes apart for fitting a boat thwart (or any bench-type structure for that matter) of any width within that range. Leaf spring 35 has integral side flanges 39 (FIG. 4) extending down on the sides of arm 17 and a slot 41 extending across the top of the spring and down into the flanges 39.

Figure 8:
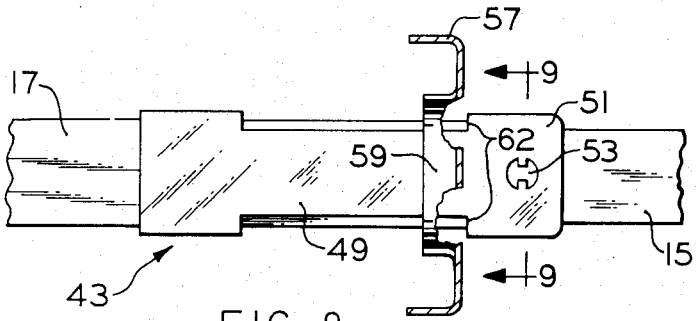
FIG. 8 is a section on line 8—8 of FIG. 4, which further illustrates the details of the snap-fastener assembly.
Figure 9:
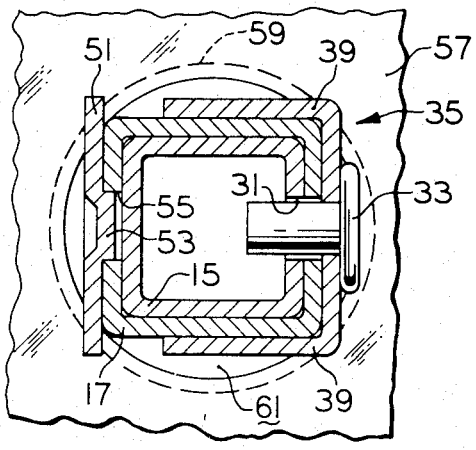
FIG. 9 is an enlarged section on line 9—9 of FIG. 8.

As shown in FIGS. 2 and 4 of the drawings, leaf spring 35 is held on the arm 17 by a clip, generally designated 43, at the left end of the spring (see FIGS. 2 and 4), the latter having a boss 45 thereon receivable in a hole 47 in arm 17 for preventing the spring from sliding along the arm. Clip 43 has a relatively long narrow shank 49 (FIG. 8) extending outwardly along the underside of arm 17, which shank has at its outer end an enlarged head 51. A boss 53 on head 51 is received in a hole 55 in arm 17 and prevents the clip from sliding on the arm. Thus, with bosses 45 and 53 in their respective holes 47 and 55, the entire snap-fastener assembly 29 is rigidly secured to the arm 17. This clip-on arrangement as described is advantageous inasmuch as it allows ready assembly and, if necessary, disassembly of the snap-fastener assembly 29.

For easy storage and transport of the boat seat mounting unit 1, arms 15, 17 are mounted on the base 5 for rotation about their axes from an unfolded clamping position (shown in solid lines in FIG. 1) in which the outer end portion 21 of each arm extends downwardly along a respective side of the thwart for engaging the thwart to a folded portable position (shown in phantom lines) in which the outer end portion of each arm extends along the base 5 in a plane generally parallel to the top surface of the thwart. More specifically, arm 17 is journaled beneath base 5 in a pair of bearings, each indicated at 57, between the mounting plate 7 and the bottom of the U-shaped members 9. As illustrated best in FIGS. 3, 4 and 8, each of these bearings 57 has an inwardly directed flange 59 defining an opening 61 and providing a bearing surface upon which the arm 17 is supported for rotation. Axial movement of arm 17 relative to bearings 57 is limited by interaction between the right bearing and leaf spring 35 and clip 43. In this regard, leftward movement of arm 17 is prevented by the abutment at 62 of the enlarged head 51 of clip 43 against the outer face of bearing 57 (FIG. 8), while movement of the arm to the right is precluded by the abutment at 63 of the leaf spring against bearing flange 59 (which extends through slot 41 in the leaf spring).

Boat seat mounting unit 1 further includes means for locking the arms 15, 17 in their unfolded and folded positions. This means consists of a generally U-shaped locking lever, generally designated 64, having two parallel legs 65, 67 pivoted at 68 (see FIGS, 2, 3 and 5) to the upper end of the bearing at the left side of the base 5 for swinging between a locking position (shown in solid lines in the drawings) in which the arms are locked in position and a release position in which the arms are free to rotate. The legs 65, 67 of the locking lever 64 are spaced apart a distance slightly greater than the width of arm 17 so that when the lever is moved via grip 69 to its locking position, arm 17 is snugly received between legs 65, 67 for locking both arms 15, 17 in position. Thus, the arms may readily be locked in either an unfolded position for clamping the unit on the thwart or in a folded portable position in which the unit is collapsed for easy transport and storage.

Figure 6:
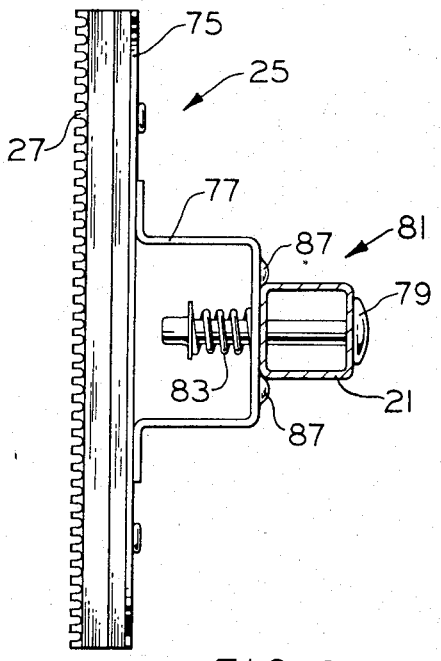
FIG. 6 is an enlarged section on line 6—6 of FIG. 2.
Figure 7:
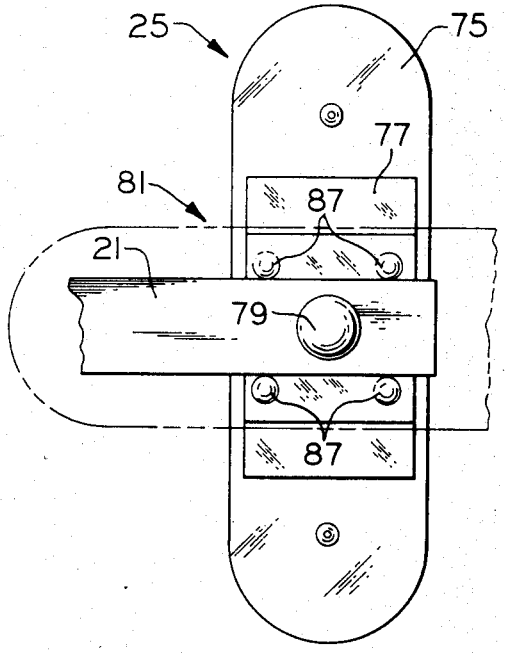
FIG. 7 is a view of the right side of FIG. 6.

As illustrated in FIG. 2, the opposed elongate shoes 23, 25 are mounted on the downwardly-turned outer end portions 21 of arms 17, 15, respectively, for rotation about a horizontal axis generally parallel to the inner portions 19 of the arms. The shoe 23 at the left of the base 5 is mounted on one end of a rod 71 threaded through arm 17. Clockwise rotation of rod 71 by means of a lever 73 pinned to the opposite end of the rod advances the shoe 23 inwardly relative to arm 17. Thus, the rod 71 and lever 73 constitute fine adjustment means for precisely drawing shoes 23, 25 into clamping engagement with opposite sides of the thwart 3. As shown in FIG. 6, shoe 25 at the right side of the base includes a pad support 75 mounted on the arm by means of a U-shaped bracket 77, the latter being rotatable on a pin 79 projecting from arm 15. Detent means generally indicated at 81 is provided for releasably holding the shoe 25 in a first position (shown in phantom in FIGS. 1 and 7) in which the shoe is generally parallel to the outer end portion 21 of arm 15, and in a second clamping position in which the shoe is perpendicular to outer end portion 21. This detent means 81 comprises a coil compression spring 83 on the pin 79 for biasing shoe 25 toward arm 15, and a series of four stops, each designated 87, arranged in quadrature on the face of bracket 77 adjacent arm 15. These stops are engageable with opposite sides of arm 15 when the shoe is in either of the aforementioned first and second positions for releasably holding the shoe in position.

In operation, the boat seat mounting unit of this invention may be quickly and easily unfolded from a collapsed portable position and mounted on the boat thwart 3 or the like by first pulling locking lever 64 downwardly via grip 69 from its locking position (shown in solid lines in FIG. 2) to a release position (shown in phantom) so as to allow arms 15, 17 to be rotated from their folded position (as shown in phantom in FIG. 1) to their unfolded clamping position. The arms are then locked in this latter position by swinging locking lever 64 upwardly toward the mounting plate 7 until arm 17 is snugly received between legs 65, 67 of the locking lever and locked therebetween. In order to quickly space shoes 23, 25 apart a distance roughly greater than the width of the thwart for application of the unit to the thwart, leaf spring 35 is lifted upwardly by means of finger grip 37 (thus removing detent 33 from an opening 31 in arm 15), arm 15 slidably adjusted relative to arm 17 until the shoes are spaced apart the appropriate distance, and spring 35 then released with detent 33 snapping into the selected opening 31 for securing the arms in their adjusted position. After the unit has been placed on top of the thwart 3, clamping shoes 23, 25 are rotated 90° from their portable position to a clamping position in which they are perpendicular to the arms. The rod 71 is then rotated via lever 73 in a clockwise direction to move the shoe 23 inwardly toward the side of the thwart for clamping the shoes against the sides of the thwart. Thus, the unit 1 and the boat seat thereon are rigidly mounted atop the thwart. The relatively large clamping surface area of the shoes allows the shoes to be firmly tightened against the thwart sides without damaging the thwart.

The unit 1 may be quickly and easily demounted from the thwart and collapsed to a folded portable position by simply reversing the steps as set out above.

Many thwarts, such as the one illustrated in FIG. 2, have tops which overhang the thwart sides. To permit the shoes 23, 25 to clamp flat against the thwart sides so as to provide maximum gripping power, the horizontal spacing between the outer portion 21 of the arms 15, 17 and the clamping surface of shoe padding 27 and the vertical spacing between the top of the shoes (when in a clamping position as shown in FIG. 2) and the padding 11 on the bottom of the U-shaped members 9 are made sufficient to accommodate the overhanging portions of the thwart top. Thus, the unit of this invention quickly and easily may be fitted to all types of thwarts (either with or without overhang) without requiring any modification of the thwart.

FIGS. 10–13 show a boat seat mounting unit 1*a* similar to the unit 1 previously described except that the inner portions 19*a* of the arms 15*a*, 17*a*, are relatively short and slidably received in an elongate guide, generally indicated at 89, on the underside of mounting plate 7*a*. This guide, which constitutes guide means, is generally of channel shape and has a web 91 and a pair of side flanges, each designated 93, the outer margins of which are bent laterally outwardly to form lips 95 at opposite sides of guide 89. The guide is secured (as by welding) to plate 7*a* with its open side toward the plate and closed by the latter forming a guideway 97 generally square in transverse section as shown best in FIGS. 11 and 12. The arms 15*a*, 17*a*, are slidable in this guideway 97 for axial adjustment of the arms to space the shoes 23*a*, 25*a*, apart a distance somewhat greater than the width of a thwart for application of unit 1*a* to the thwart as explained above with respect to unit 1. Although guide 89 is shown to comprise but a single elongate channel, it will of course be understood that a pair of shorter channels, one for each arm, could also suitably be used without departing from the scope of this invention.

Indicated generally at 99 is detent means for securing each arm 15*a*, 17*a*, in any one of a plurality of axially adjusted positions. More particularly, detent means 99 comprises a spring loaded detent pin 101 biased into a selected one of a series of openings, each indicated at 103, spaced along the inner portion 19*a* of each arm (see FIG. 13). This detent pin 101 is mounted in a horizontal sleeve 105 and is movable to the left and right (as viewed in FIG. 12) in the sleeve between a locking position (shown in FIG. 12) in which its right end extends through a hole 107 in the left side flange 93 of guide 89 and an opening 103 in a respective arm for securing the latter in adjusted position in guideway 97, and a leftward retracted position in which the pin is removed from opening 103, allowing the arm to be slid relative to guide 89. A spring 109 around pin 101 and reacting from the left end of sleeve 105 against a flange 111 toward the right end of the pin biases the pin to the right toward its locking position. An enlarged annular head 113 at the left end of pin 101 serves as a knob for pulling the pin from its retracted to its locking position.

Figure 10:
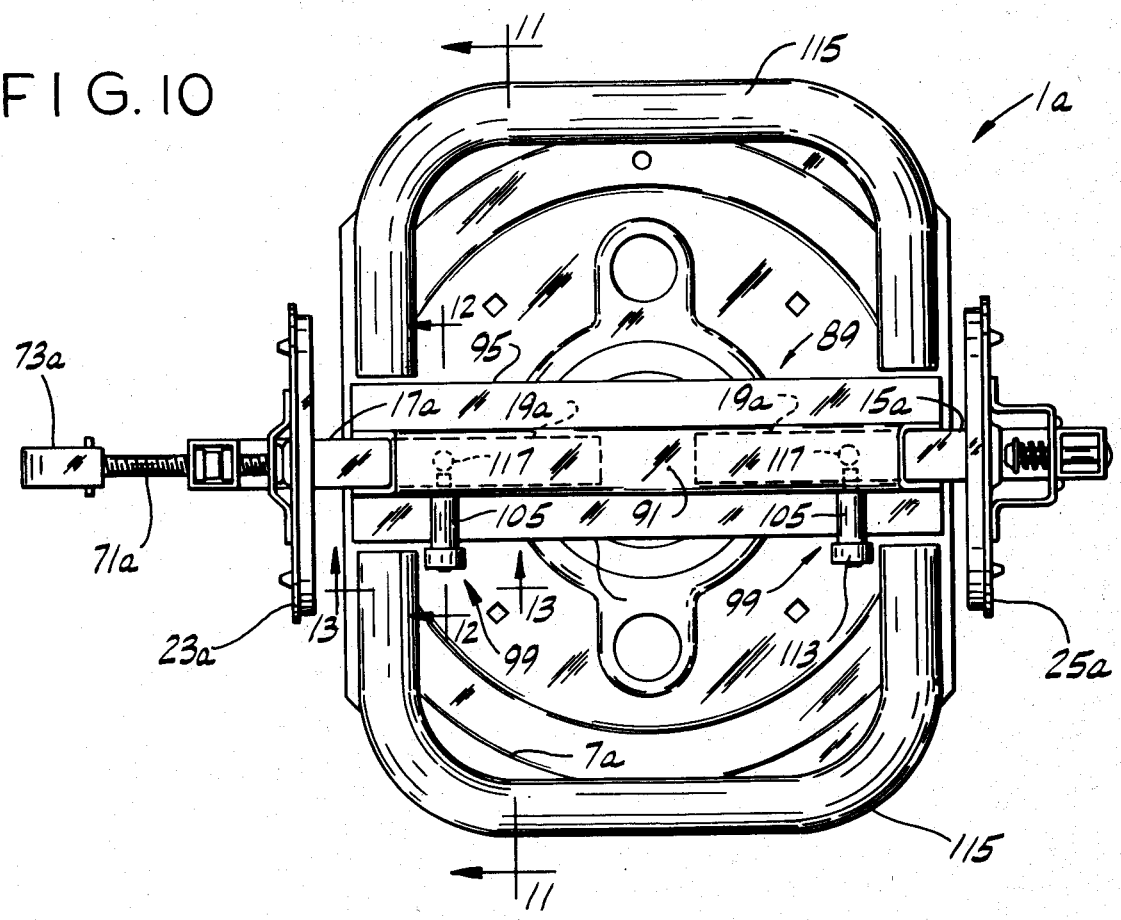
FIG. 10 is a bottom view of an alternative boat seat mounting unit of this invention.
Figure 11:
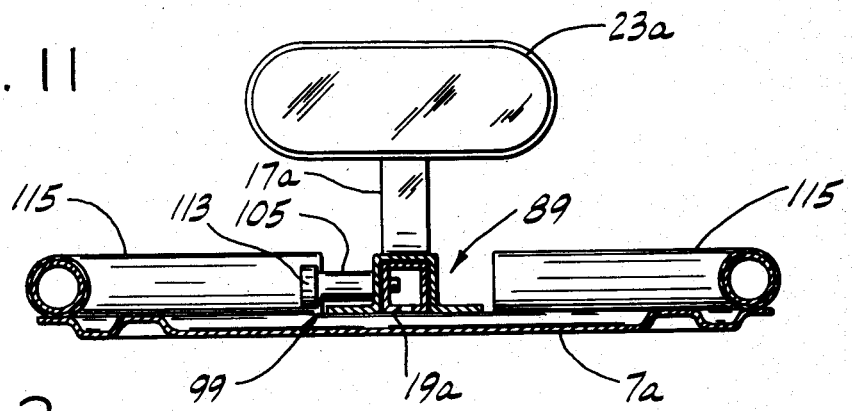
FIG. 11 is a section along line 11—11 of FIG. 10 illustrating guide means of this invention.
Figure 12:
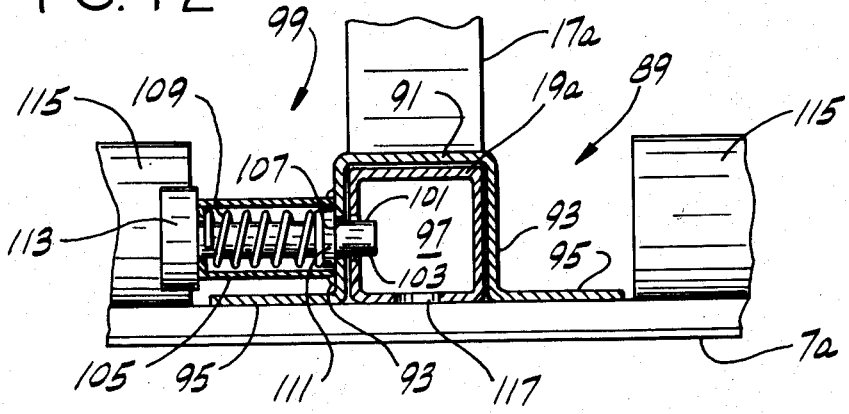
FIG. 12 is an enlarged section on line 12—12 of FIG. 10.
Figure 13:
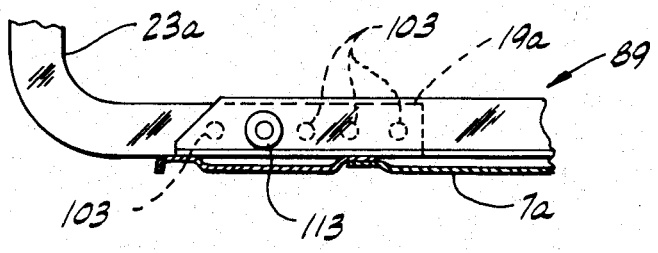
FIG. 13 is a section on line 13—13 of FIG. 10.

Once both arms 15*a*, 17*a* have been secured in their adjusted positions (in which shoes 23*a*, 25*a* are spaced apart a distance greater than the width of a thwart for application of unit 1*a* to the thwart), the shoes are precisely adjusted by rotating rod 71*a* via lever 73*a* to move shoe 23*a* inwardly toward the thwart to draw the shoes into clamping engagement with opposite sides of the thwart in the same manner described above with respect to unit 1. A pair of round tubular legs (constituting leg means) 115, generally U-shaped as viewed in FIG. 10, are secured by welding, for example, to the bottom of mounting plate 7*a* for supporting the unit 1*a* on a thwart with the mounting plate 7*a* and guide 89 disposed above the thwart. These spacers 115 are coated with a relatively soft material (rubber, for example) for preventing the thwart from being scratched or otherwise damaged.

The arms 15*a*, 17*a*, are readily movable from the unfolded clamping position shown in FIGS. 10–13 to a folded clamping position by pulling each detent pin 101 to its retracted position, sliding arms 15*a*, 17*a* out of guide 89 and rotating them 90°, and then reinserting the arms back into the guide until each pin 101 snaps into an opening 117 in a respective arm, this opening 117 being in a side of each arm adjoining the side having openings 103 therein. Although not shown, the side of each arm 15*a*, 17*a*, opposite the side with openings 103 therein may also have openings identical to openings 103 spaced along it so that the arms may be interchangeably slid into either end of guide 89 and secured in their axially adjusted, clamping positions.

Referring now to FIGS. 14–17, another unit 1*b* of this invention, similar to units 1 and 1*a*, is shown as comprising a pair of tubular arms 15*b*, 17*b* generally circular in section and slidably adjustable in a channel-shaped guide generally indicated at 119 similar to guide 89 of unit 1*a*. This guide 119 has a web 121, and two side flanges 123 with the outer margins of these flanges being bent to form lips such as indicated at 125. To secure arms 15*b*, 17*b* in axially adjusted position in guide 119 (i.e., a position wherein the shoes 23*b*, 25*b* have been spaced apart a suitable distance for application of the unit 1*b* to a thwart), the inner portion 19*b* of each arm has a series of openings, each indicated at 127, spaced along the length thereof for receiving a detent 129 carried at the outer end (the left end as viewed in FIG. 15, for example) of an elongate steel spring generally indicated at 131 which biases detent 129 through a hole 133 in a side flange 123 of guide 119 (see FIG. 15) and into the appropriate opening 127 in the arm. With detent 129 in opening 127, the arm is also prevented from rotating and is locked in its unfolded clamping position. Springs 131, mounted on opposite sides of guide 119, are secured by rivets 135 or the like at their inner ends to respective side flanges 123 of the guide and extend out along the guide toward opposite ends thereof. Each spring 131 is bent out away from guide 119 at its outer end as indicated at 137 for providing a finger grip to lift the detent 129 out of an opening 127, thus allowing a respective arm to be axially adjusted in or out of guide 119 or rotated to its folded portable position. In this latter regard, a hole 139 is provided in the bottom (as viewed in FIG. 16) of each arm 15*b*, 17*b* for receiving detent 129 to lock the arm in its folded position. A brace 141 is provided at the outer end of each spring 131 to stiffen the latter. This brace is generally L-shaped, one leg being secured to the spring by detent 129 (which may be a rivet) and the other extending out along a lip 125 of guide 119 and bent under the lip.

Figure 14:
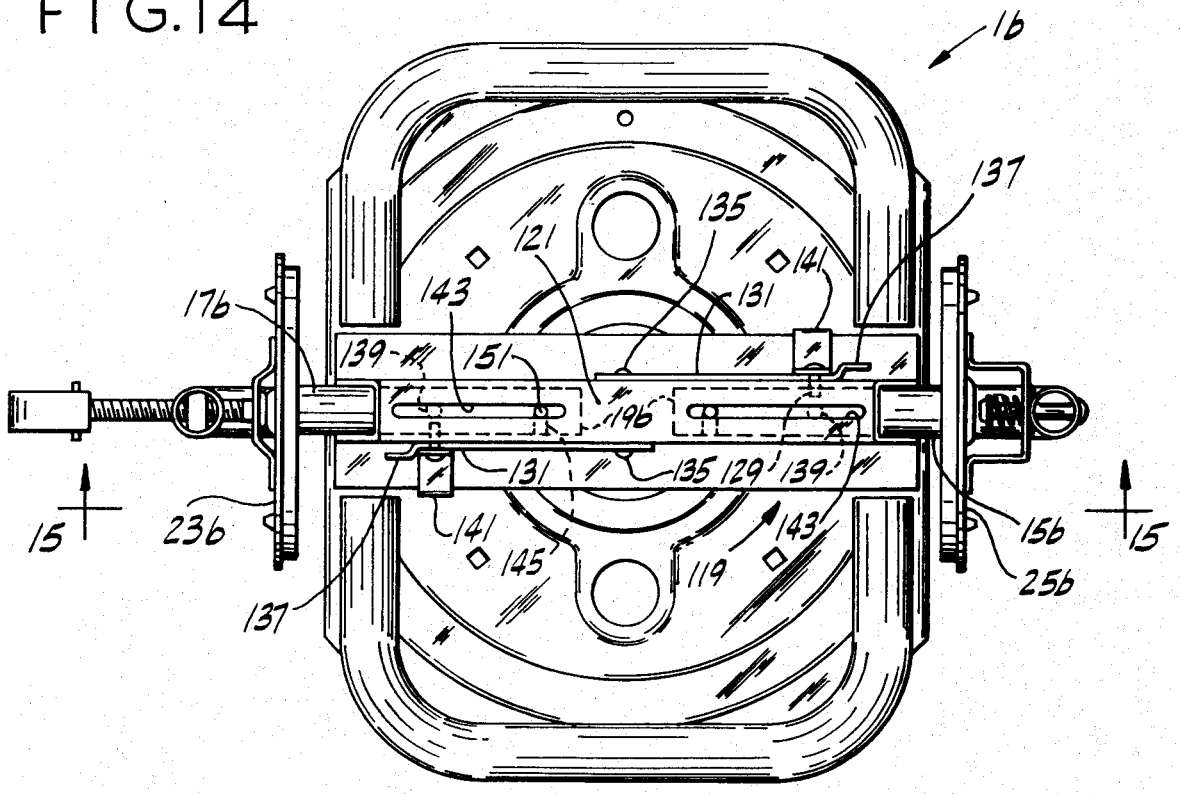
FIG. 14 is a bottom view of another boat seat mounting unit of this invention.
Figure 15:
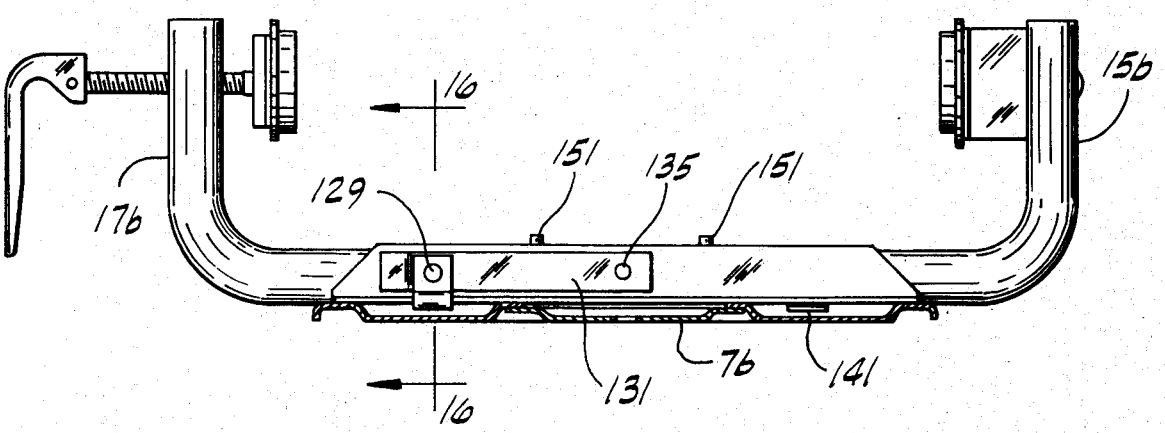
FIG. 15 is a section on line 15—15 of FIG. 14.
Figure 16:
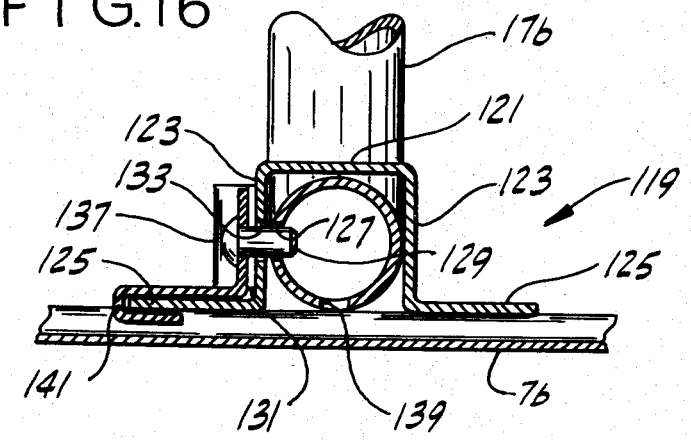
FIG. 16 is an enlarged section on line 16—16 of FIG. 15.
Figure 17:
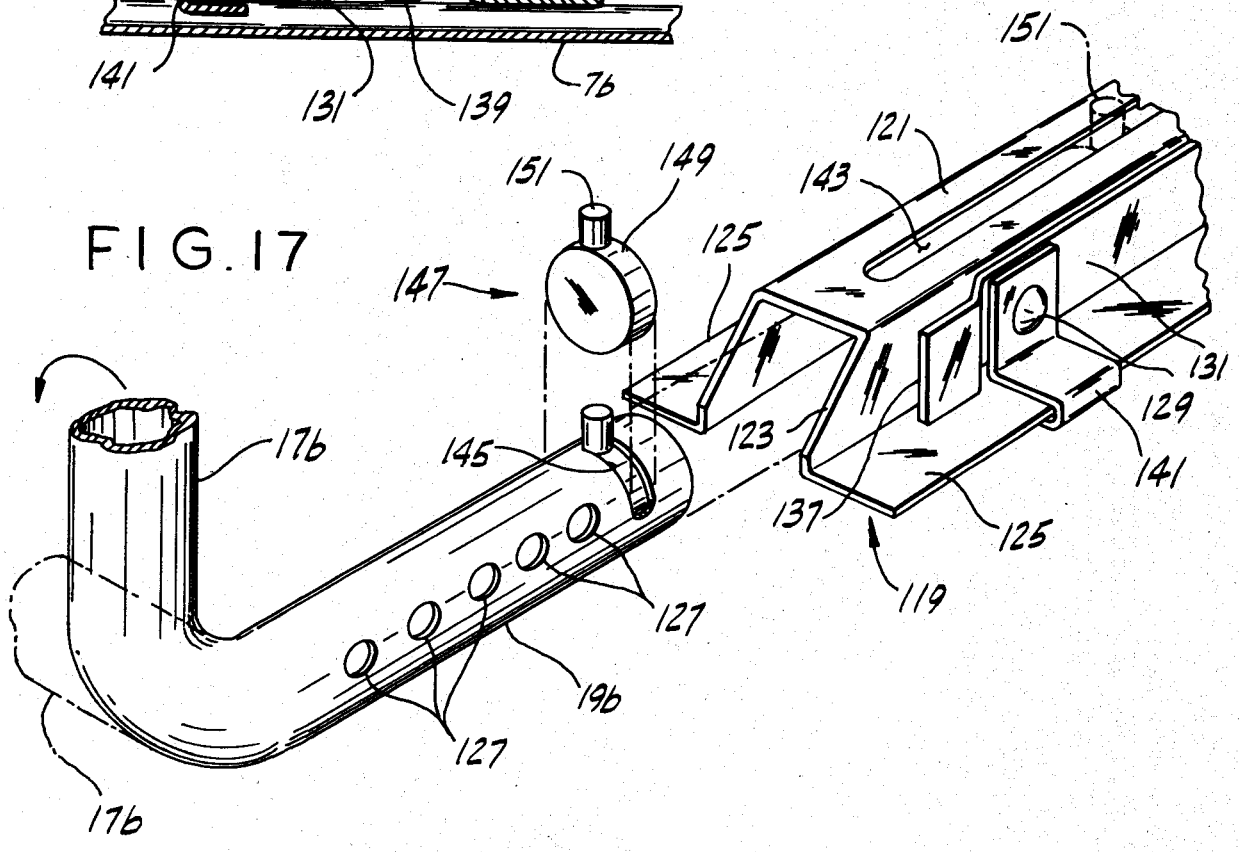
FIG. 17 is an exploded view of an arm, guide means and stop means of this invention.

As best illustrated in FIGS. 14 and 17, web 121 of guide 119 has a pair of elongate slots 143 (together constituting slot means) therein toward opposite ends of the guide, and the inner portion 19*b* of each of the arms 15*b*, 17*b* has a circumferential slot 145 therein toward its inner end extending through 90° of the circumference of the arm. The lower end (as viewed in FIG. 17) of this circumferential slot 145 is generally on a line through openings 127. Indicated generally at 147 is stop means for limiting rotation of each arm to rotation between its folded and unfolded positions and also for preventing the arm from being pulled completely out of guide 119. More specifically, this means 147 comprises a cylindrical member 149, freely rotatable in a respective arm. A pin 151 extends radially from member 149 and projects through slot 145 in the respective arm and thence through the respective elongate slot 143 in guide 119. Thus, movement of pin 151 relative to the guide is restricted to movement lengthwise of the guide in slot 143. And inasmuch as the pin is engageable with guide 119 at the outer end of slot 143, the respective arm is prevented from being pulled completely out of the guide. On rotation of an arm (arm 17*b*, for example) in guide 119, pin 151 moves relative to the arm in circumferential slot 145, and portions of the arm defining the ends of slot 145 engage the pin when the arm reaches its folded and unfolded positions for limiting rotation of the arm to rotation between those positions.

It will be understood that guide 119, instead of being generally of channel shape, could be U-shaped in cross section and have lips similar to lips 125 of guide 119 bent laterally outwardly from the legs of the U and rigidly affixed to plate 7*b* as by welding.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A unit for mounting a seat on a boat thwart or the like, said unit comprising a base adapted to rest on the thwart and to have said seat secured thereto, means carried by the base for clamping it on the thwart, said clamping means comprising a pair of arms extending outwardly from opposite sides of the base, a clamping shoe at the outer end of each arm, said shoes being engageable with opposite sides of the thwart for clamping the base thereto, rough adjustment means for quickly adjusting the shoes to space them apart a distance somewhat greater than the width of the thwart for application of the unit to the thwart, fine adjustment means for precisely adjusting the shoes to draw them into clamping engagement with opposite sides of the thwart, said arms being readily movable in the base between an unfolded clamping position in which the shoes are engageable with said thwart and a folded portable position, and means for locking the arms in said unfolded position, said arms being telescopically fitted together for slidably adjusting the arms relative to one another, said rough adjustment means comprising a snap fastener assembly for snap-fastening the arms in any one of a plurality of predetermined adjusted positions, said assembly comprising a series of openings in one arm spaced along the length of the arm, a detent on the other arm, and spring means on said other arm for biasing the detent into any selected opening, said spring means comprising a leaf spring extending lengthwise of said other arm, said spring being secured at one end to said other arm and having said detent at its other free end adapted to snap into any selected opening, said spring being held on said other arm by a clip at said one end of the spring, said clip being of separate construction from the spring and the latter having a boss thereon receivable in a hole in said other arm for preventing the spring from sliding along the arm.

2. A boat seat mounting unit as set forth in claim 1 wherein said clip has a boss thereon adapted to be received in a hole in said other arm for preventing the clip from sliding on the arm.

3. A boat seat mounting unit as set forth in claim 1 wherein said fine adjustment means comprises means for moving a shoe carried by an arm at one side of said base lengthwise of the arm.

4. A boat seat mounting unit as set forth in claim 3 wherein said shoe is threadably mounted on said arm.

5. A unit for mounting a seat on a boat thwart or the like, said unit comprising a base adapted to rest on the thwart and to have said seat secured thereto, means carried by the base for clamping it on the thwart, said clamping means comprising a pair of arms extending outwardly from opposite sides of the base, a clamping shoe at the outer end of each arm, said shoes being engageable with opposite sides of the thwart for clamping the base thereto, rough adjustment means for quickly adjusting the shoes to space them apart a distance somewhat greater than the width of the thwart for application of the unit to the thwart, fine adjustment means for precisely adjusting the shoes to draw them into clamping engagement with opposite sides of the thwart, said arms being journalled in said base for conjoint rotation about their axes from an unfolded clamping position in which the shoes are engageable with the thwart to a folded portable position, and means for locking the arms in said unfolded position comprising a locking lever mounted on said base for moving between a locking position in which the arms are locked in said unfolded position and a release position in which said arms are rotatable out of said unfolded position, said locking lever being generally U-shaped and having two parallel legs for receiving an arm therebetween when said lever is in its locking position, said legs being spaced apart a distance slightly greater than the width of the arm whereby when the arm is received between said legs the arms are locked in a desired position.

6. A boat seat mounting unit as set forth in claim 5 wherein said arms are tubes of generally square cross section and said locking lever is adapted to selectively lock the arms in said folded or said unfolded position.

7. A boat seat mounting unit as set forth in claim 5 wherein each of said arms has an outer end portion extending generally perpendicularly from the inner portion of the arm.

8. A boat seat mounting unit as set forth in claim 7 wherein said arms are movable between an unfolded position in which said outer end portion of each of the arms extends downwardly along the respective side of the thwart for engaging the thwart and a folded portable position in which the outer end portion of each arm extends alongside the base in a plane generally parallel to the top surface of the thwart.

9. A boat seat mounting unit as set forth in claim 7 wherein said shoes are mounted on the outer end portion of each respective arm for rotation about an axis generally parallel to the inner portion of the arm.

10. A boat seat mounting unit as set forth in claim 5 wherein said base comprises a plate for having said seat secured thereto, and a pair of U-shaped members on the bottom of the plate engageable with the top of the thwart for supporting the plate above the thwart.

11. A unit for mounting a seat on a boat thwart or the like, said unit comprising a base adapted to rest on the thwart and to have said seat secured thereto, means carried by the base for clamping it on the thwart, said clamping means comprising a pair of arms extending outwardly from opposite sides of the base, a clamping shoe at the outer end of each arm, said shoes being engageable with opposite sides of the thwart for clamping the base thereto, rough adjustment means for quickly adjusting the shoes to space them apart a distance somewhat greater than the width of the thwart for application of the unit to the thwart, fine adjustment means for precisely adjusting the shoes to draw them into clamping engagement with opposite sides of the thwart, each of said arms having an outer end portion extending generally perpendicularly from the inner portion of the arm, an elongate shoe mounted on the outer end portion of each respective arm for rotation about an axis generally perpendicular to said outer end portion, and spring detent means for releasably holding at least on of said shoes in first position in which the shoe is generally parallel to the outer end portion of the respective arm and in a second clamping position in which the shoe is generally perpendicular to the outer end portion of the arm.

12. A unit for mounting a seat on a boat thwart or the like, said unit comprising a base adapted to rest on the thwart and to have said seat secured thereto, means carried by the base for clamping it on the thwart, said clamping means comprising a pair of arms extending outwardly from opposite sides of the base, a clamping shoe at the outer end of each arm, said shoes being engageable with opposite sides of the thwart for clamping the base thereto, rough adjustment means for quickly adjusting the shoes to space them apart a distance somewhat greater than the width of the thwart for application of the unit to the thwart, fine adjustment means for precisely adjusting the shoes to draw them into clamping engagement with opposite sides of the thwart, each of said arms having an outer end portion extending generally perpendicularly from the inner portion of the arm, an elongate shoe mounted on the outer end portion of each respective arm for rotation about an axis generally parallel to the inner portion of the arm, and detent means for releasably holding at least one of said shoes in a first position in which the shoe is generally parallel to the outer end portion of the respective arm and in a second clamping position in which the shoe is generally perpendicular to the outer end portion of the arm, said detent means comprising a spring for biasing said one shoe against the respective arm and a series of stops on the shoe engageable with the arm for releasably holding the shoe in said first and second positions.

13. A unit for mounting a seat on a boat thwart or the like, said unit comprising a base adapted to rest on the thwart and to have said seat secured thereto, means carried by the base for clamping it on the thwart, said clamping means comprising a pair of arms extending outwardly from opposite sides of the base, a clamping shoe at the outer end of each arm, said shoes being engageable with opposite sides of the thwart for clamping the base thereto, guide means on the base for guiding the arms for axial adjustment of the arms to space the shoes apart a distance somewhat greater than the width of the thwart for application of the unit to the thwart, means for securing the arms in adjusted position in the guide means, and fine adjustment means for precisely adjusting the shoes to draw them into clamping engagement with opposite sides of the thwart, said arms being readily movable between an unfolded clamping position in which the shoes are engageable with the thwart and a folded portable position, the arms being in the guide means when in said folded and unfolded positions, said base comprising a mounting plate for having said seat secured thereto, and said guide means being mounted on the underside of the plate and defining a guideway immediately adjacent the plate, said arms being axially adjustable in the guideway for adjusting the spacing between said shoes, said guide means not extending substantially outwardly beyond the sides of the plate thereby to enable said shoes to be spaced relatively close together for application of the unit to relatively narrow thwarts, said mounting plate having leg means thereon engageable with the top of a thwart for supporting the plate and said guide means above the thwart.

14. A boat seat mounting unit as set forth in claim 13 wherein said guide means comprises an elongate guide rigidly affixed to the bottom of said mounting plate.

15. A boat seat mounting unit as set forth in claim 14 wherein said guide is generally of channel shape with its open side toward said plate and closed by the latter forming said guideway, the latter being generally square in cross section.

16. A boat seat mounting unit as set forth in claim 15 wherein each of said arms is tubular, generally square in section, and slidably removable from said guide for moving the arm between its folded and unfolded positions.

17. A boat seat mounting unit as set forth in claim 15 wherein each of said arms is tubular, generally circular in section, and rotatable in said guide about its axis between said folded and unfolded positions.

18. A boat seat mounting unit as set forth in claim 17 further comprising stop means for preventing a respective arm from being pulled completely out of the guide.

19. A boat seat mounting unit as set forth in claim 18 wherein said stop means also limits rotation of said arm to rotation between said folded and unfolded positions.

20. A boat seat mounting unit as set forth in claim 19 wherein said guide has elongate slot means therein extending lengthwise of the guide, and each of said arms has a circumferential slot therein toward its inner end, said stop means comprising a pin projecting out from the inside of each arm through said circumferential slot and thence through said slot means with movement of the pin relative to the guide being restricted to movement lengthwise of the guide in said slot means, said pin being engageable with the guide at an outer end of the slot means to prevent the arm from being pulled completely out of the guide, and portions of the arm defining the ends of said circumferential slot being engageable with said pin on rotation of the arm between said unfolded and folded position for limiting rotation of the arms to rotation between said portions.

21. A boat seat mounting unit as set forth in claim 14 further comprising stop means for preventing an arm from being pulled completely from the guide.

* * * * *

UNITED STATES PATENT AND TRADEMARK OFFICE

CERTIFICATE OF CORRECTION

PATENT NO. : 4,281,426

DATED : August 4, 1981

INVENTOR(S) : Denis S. Moeser

It is certified that error appears in the above—identified patent and that said Letters Patent is hereby corrected as shown below:

Front page, item [63], "Pat. No. 4,122,571" should read --now abandoned--. Column 1, line 7, "now U.S. Pat. No. 4,122,571" should read --abandoned June 9, 1978--. Column 9, claim 11, line 68, "at least on" should read --at least one--; line 68, "in first" should read --in a first--.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*